US005516203A

United States Patent [19]

Branham et al.

[11] Patent Number: 5,516,203

[45] Date of Patent: May 14, 1996

[54] SMALL PARTS CABINET HAVING SELF-EJECTING BINS

[75] Inventors: Rick Branham, Mansfield; Randall W. Calmeise, Oakwood Village; John A. Vura, Wooster, all of Ohio

[73] Assignee: Rubbermaid Incorporated, Wooster, Ohio

[21] Appl. No.: 289,466

[22] Filed: Aug. 12, 1994

[51] Int. Cl.[6] ..... A47B 88/18

[52] U.S. Cl. ..... 312/324; 312/319.3; 312/902; 16/82

[58] Field of Search ..... 312/324, 257.1, 312/319.1, 319.2, 319.3, 244, 902, 333, 222; D3/315, 319, 905, 272, 282; 16/82; 206/372, 373, 315.11

[56] References Cited

U.S. PATENT DOCUMENTS

| | | | |
|---|---|---|---|
| D. 139,710 | 12/1994 | Mueller | D6/510 |
| 405,003 | 6/1889 | Blackledge | 312/217 X |
| 918,471 | 4/1909 | Reaves | 312/324 X |
| 997,328 | 7/1911 | Ringer | 312/324 X |
| 1,785,666 | 12/1930 | Bachelder | 312/324 X |
| 2,714,444 | 8/1955 | Shippen | 312/324 X |
| 2,819,142 | 11/1958 | Barrett | 312/329 X |
| 2,877,077 | 3/1959 | Robinson et al. | 312/324 X |
| 3,087,770 | 4/1963 | Gettel | 312/324 X |
| 3,876,271 | 4/1975 | Skirlock | 312/244 X |
| 4,024,954 | 5/1977 | Staar | 312/319.1 X |
| 5,117,979 | 6/1992 | Brightbill | 312/902 X |

FOREIGN PATENT DOCUMENTS

| | | | |
|---|---|---|---|
| 149136 | 11/1952 | Australia | 312/324 |
| 233813 | 8/1944 | Switzerland | 312/324 |

*Primary Examiner*—Peter M. Cuomo
*Assistant Examiner*—Janet M. Wilkens
*Attorney, Agent, or Firm*—Richard B. O'Planick; Lisa B. Riedesel

[57] ABSTRACT

A multi-compartment storage cabinet (10) is disclosed, comprising a housing (12), a cover member (52), and a plurality of bins (62). The housing (12) is configured to provide tandem vertical pivot rods (48) extending down the middle of the housing, and a column of storage compartments (26) on each side. Each bin (62) and compartment (26) are of triangular configuration, and the bins (62) are pivotally coupled at an inward corner to the pivot rods (48), whereby enabling the bins to individually pivot between a storage position within the compartments and an open position outside of the compartments. Leaf spring members (30) are formed in the housing to engage shoulders (76) of the bins (62) as the bins reach the storage configuration and lock the bins within the housing. The spring members (30) further apply a directional ejection force on the bins as the bins are rotated out of the storage position, to assist in pivoting the bins out of their respective compartments. Each bin (62) has a corner flange (73) that resides in a corner recess (38) of the housing to assist the user in grasping the bin and initiating pivotal movement of the bin.

23 Claims, 7 Drawing Sheets

SMALL PARTS CABINET HAVING SELF-EJECTING BINS

BACKGROUND OF THE INVENTION

1. Field of the Invention

The subject invention relates generally to storage cabinets having a plurality of drawers or bins, and in particular to mobile small parts storage cabinets having bins that are individually accessible for selective extraction of desired parts.

2. The Prior Art

Small part storage cabinets for workshop or home use are well-known consumer items. Typically, such cabinets comprise a plurality of plastic bins that are housed within cabinet housing compartments, each bin serving as a drawer. The multiple bins are filled with select sizes or types of small parts that can be individually accessed by selecting the appropriate bin and opening the bin by sliding it forward.

Conventional bins also facilitate the transportation of the storage cabinet from one location to another by providing a handle at the top by which the cabinet may be lifted and moved. The cabinet and the bins are formed by conventional means of plastic material and are thus relatively inexpensive to manufacture.

While the available compartmented storage cabinets work well and have been commercially successful, certain shortcomings prevent them from satisfying all of the needs of consumers. First, available bin drawers are prone to escape the confines of the cabinet compartment as they are pulled outward, resulting in spillage. In addition, the bins do not provide a positive lock for retaining the drawer bins inside the cabinet during transport, and the bins can inadvertently open and spill in transit. Lastly, the bins lack a mechanical assist during the opening procedure. Consequently, a user must pull a fully loaded drawer outward without assistance from the cabinet.

SUMMARY OF THE INVENTION

The subject invention overcomes the deficiencies in available multi-compartment storage cabinets by providing a storage cabinet having pivotally opening and closing storage bins. The housing is configured having dual vertical pivot rods positioned along the vertical center axis and extending from a top to a bottom of the housing. Dual arrays of vertically oriented bin compartments flank the pivot rods. Each compartment is triangular in shape and receives a triangular shaped small parts bin. The bins are pivotally connected to the pivot rods at an inward corner and rotated between a storage position within the housing compartments and an open position forward of the housing compartments.

The bins thus may be opened individually by pivotal movement. Each bin is securely coupled to a pivot rod and therefore cannot fall from the housing and spill. Moreover, throughout the pivotal path of motion, the bins remain in a horizontal and level configuration and the parts remain inside the bin compartments. The bins provide a flange extension of the forward bin sidewall, with the flange extending outward beyond the lateral side of the bin and into a housing corner recess. A user grasps the flange to initiate pivotal movement of a selected bin.

The housing provides a resilient leaf spring for each compartment, the leaf spring being integrally formed with the back of the housing to extend into each bin compartment.

The bins are each formed having a detent that rides over a housing leaf spring detent, whereby securing the bin inside its respective compartment. A user initiates pivotal movement of the bin and as the bin detent escapes the leaf spring detent, the spring exerts an ejection force on the bin that pushes the bin out of its compartment.

Accordingly, it is an objective of the invention to provide a compartmented small parts storage cabinet having integral means for securing bins in their respective compartments.

A further objective is to provide a storage cabinet having mechanically assisted storage bin ejection.

Yet a further objective is to provide a storage cabinet having pivoting storage bins.

Another objective is to provide a small parts organizing cabinet having bins that may be independently opened and closed.

An additional objective is to provide a small parts cabinet comprising a relatively small number of component parts that are inexpensive to manufacture, assemble, and a cabinet that is readily used.

These and other objectives, which will be apparent to those skilled in the art, are achieved by a preferred embodiment which is described in detail below and which is illustrated by the accompanying drawings.

DESCRIPTION OF THE PREFERRED EMBODIMENT

Figure 1:
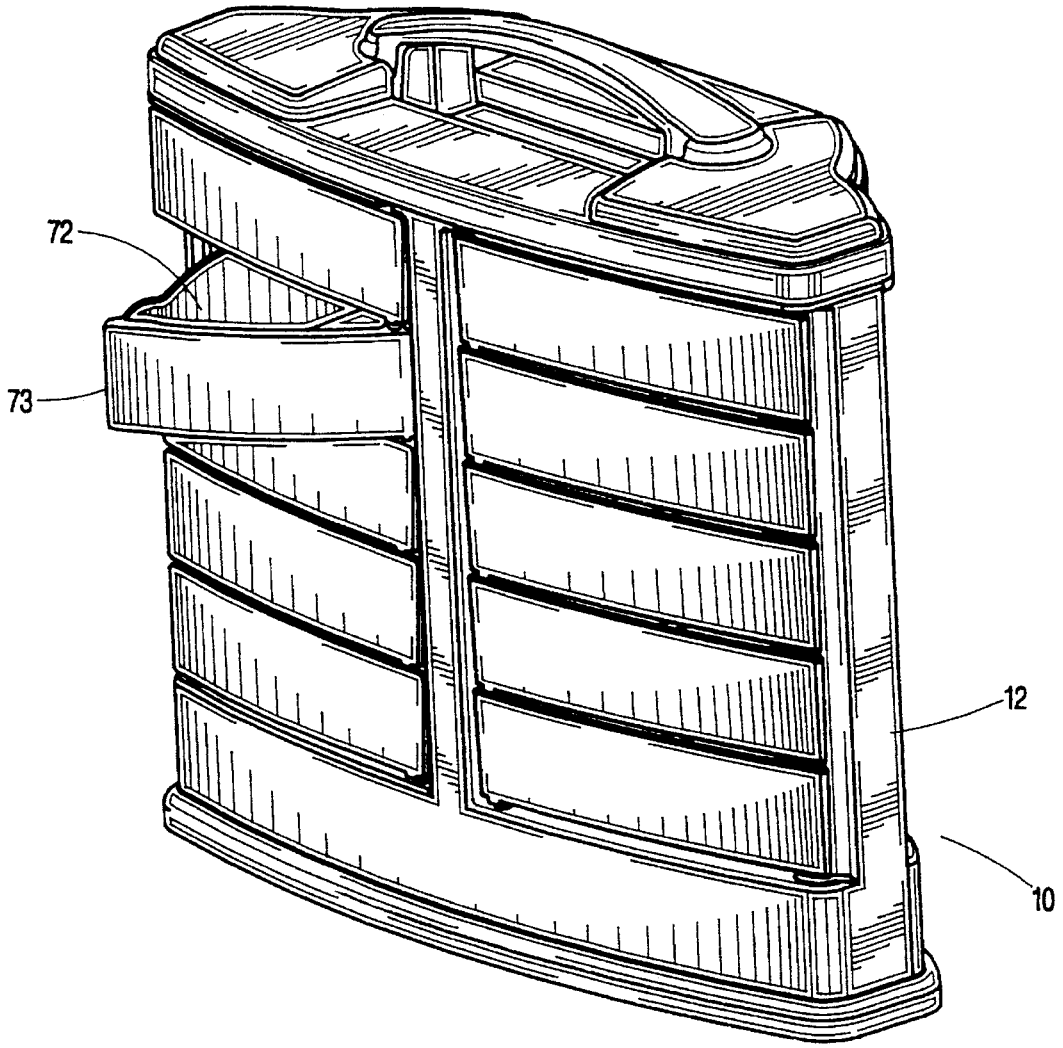
FIG. 1 is front perspective view of the subject cabinet, shown in the assembled condition.

Referring first to FIGS. 1, 2, 4, and 5, the subject small parts cabinet 10 is shown to comprise a base housing 12 having a planar bottom surface 14, a planar top surface 16, a forward panel 18, a rearward panel 20, and side panels 22, 24. The base 12 is molded by conventional means from commercially available plastics material such as polypropylene.

The base 12 is molded to form two vertical columns of bin compartments 26, each compartment 26 being defined at the bottom by a compartment ledge 28 molded into one of the side panels 22, 24, and extends rearward from the forward panel 18 to the rearward panel 20. As best seen from FIGS. 4, 6, and 7, the rearward panel 20 is molded to form dual side by side columns of horizontal leaf springs 30, each spring located in association with one of the compartments 26. The springs 30 each are formed to include a remote end portion 32 that provides an inward facing shoulder 34. The springs 30 are molded to project horizontally in cantilever fashion along the rearward panel 20, and the plastic composition of the springs 30 make them resiliently flex in an outward direction.

The rearward panel 20 is formed to have keyhole shaped apertures 35 by which the cabinet 10 may by suspended from a wall and a plurality of rectangular openings 37. The panel 20 merges into curved side portions 36 of the side panels 22, 24 as shown in FIGS. 1, 2, 5, and 6. The side panel curved portions 36 extend forwardly to planar side panels 22, 24 that continue forward to a vertical channel recess 38, with one vertical recess 38 extending vertically at each forward corner of the base housing 12. The recesses 38 provide an indentation for each of the bin corners to swing into as will be explained in greater detail below. As best appreciated from FIG. 6 each of the bin compartments 26 is of generally right triangular shape, having planar forward and inward sides, and a rearward arcuate side defined by the curved housing base portions 36.

The top surface 16 of the housing base 12 is defined by opposite enclosures 39, created by vertical peripheral shoulder flanges 40. The flanges 40 are formed to provide apertures 42 for assembly purposes. An arcuate handle 44 bridges the enclosures 39, extending between the flanges 40 thereof. A pair of vertically disposed, side by side and parallel, rod sockets 46 extend from the top surface 16 of the housing 12 to bottom socket ends 47 at the bottom surface 14 and receive elongate pivot rods 48 therein. The rods 48 are retained within the sockets 46 by means of enlarged heads 50 at upper rod ends. So positioned, the rods 48 bisect the housing 12 into two halves, each of which having one of the two columns of compartments 26.

A cover member 52 is provided to fit over the top of the base housing 12, with the cover 52 having a downturned peripheral rim 54 from which lugs 56 project inward. The cover member 52 snaps over the shoulder flanges 40 and lugs 56 enter into the flange apertures 42 to assemble the cover to the base. The cover 52 is further adapted to have a handle 58 and an opening 60 below the handle 58 for receiving the handle 44 of the housing 12, whereby handle 44 is in close, underlying proximity to the upper handle 58. Handles 44, 58 are grasped simultaneously by the user who may thusly transport the storage cabinet 10 to a remote work site if so desired. The cover member 52 encloses the upper surface 16, flanges 40, and caps 50 of the housing 12.

Figure 2:
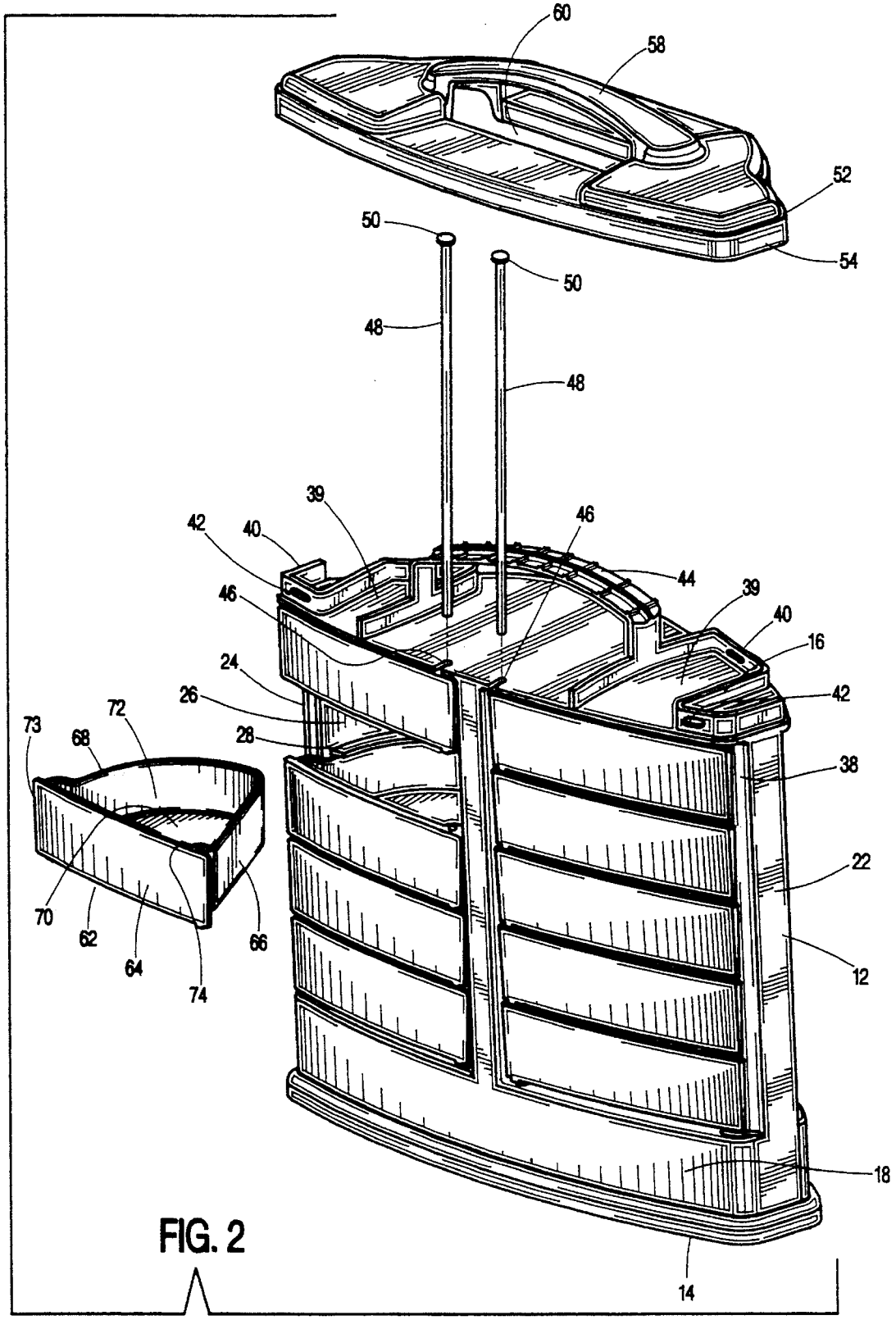
FIG. 2 is an exploded front perspective view thereof.
Figure 3:
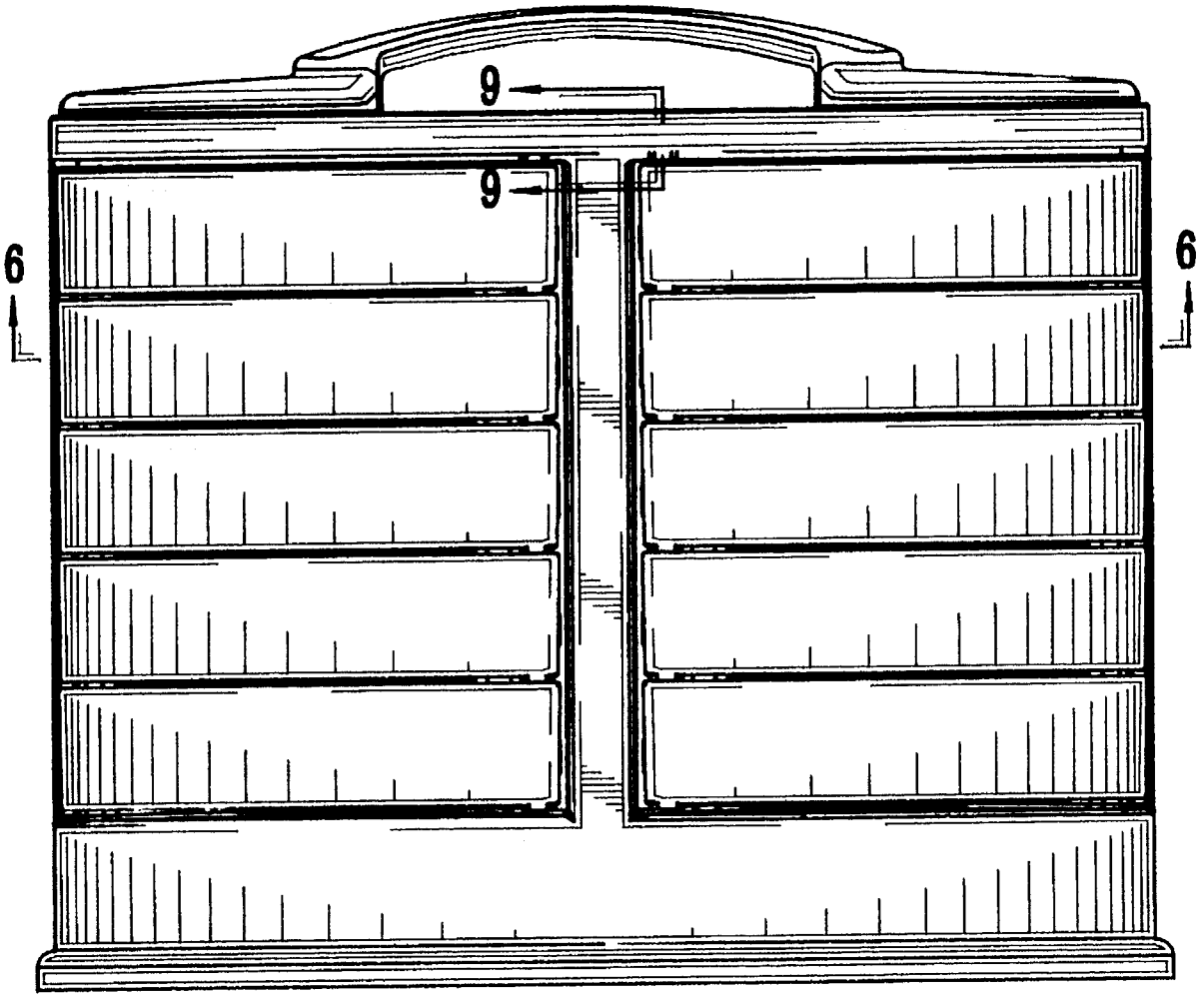
FIG. 3 is a front elevational view thereof.
Figure 4:
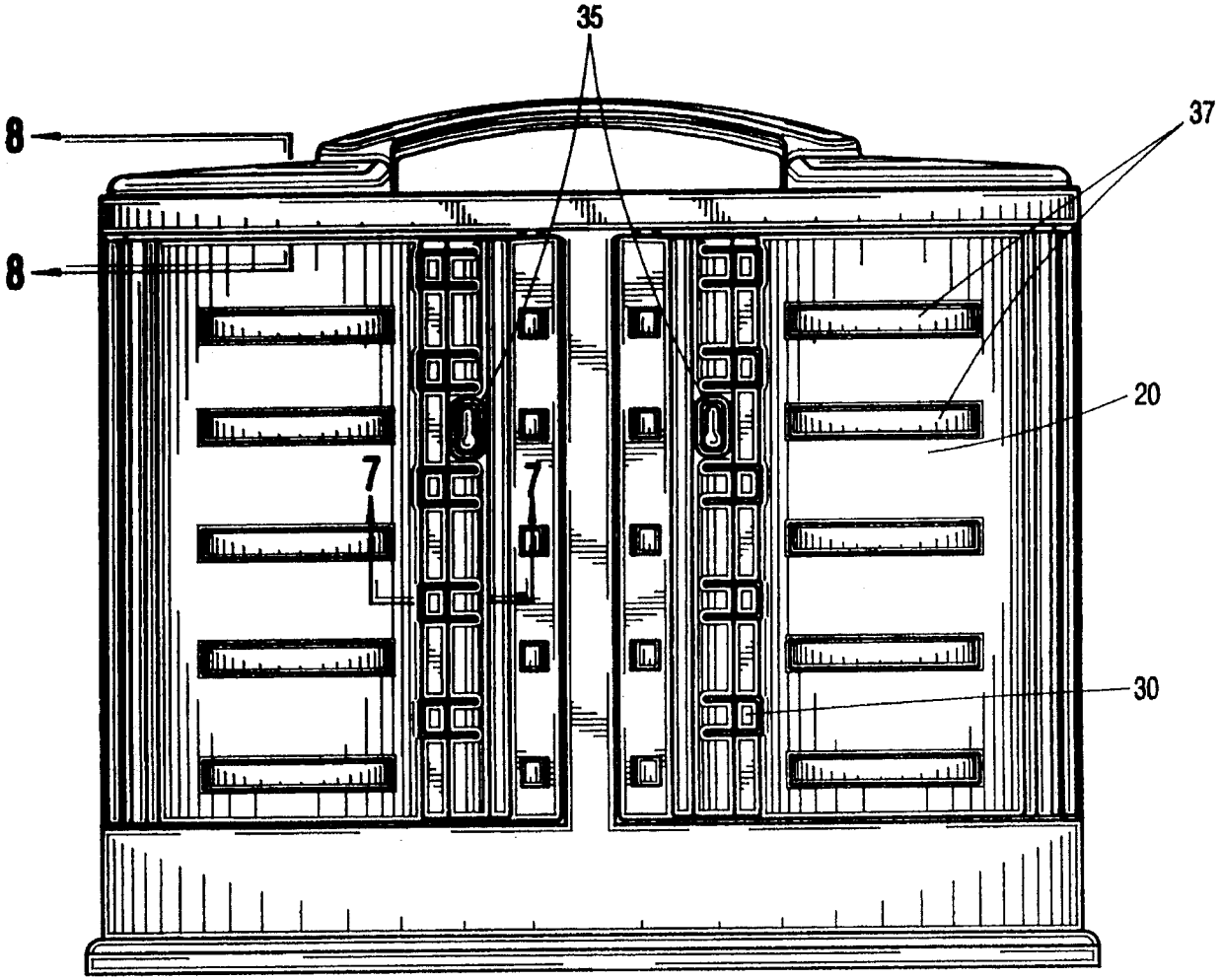
FIG. 4 is a rear elevational view thereof.
Figure 5:
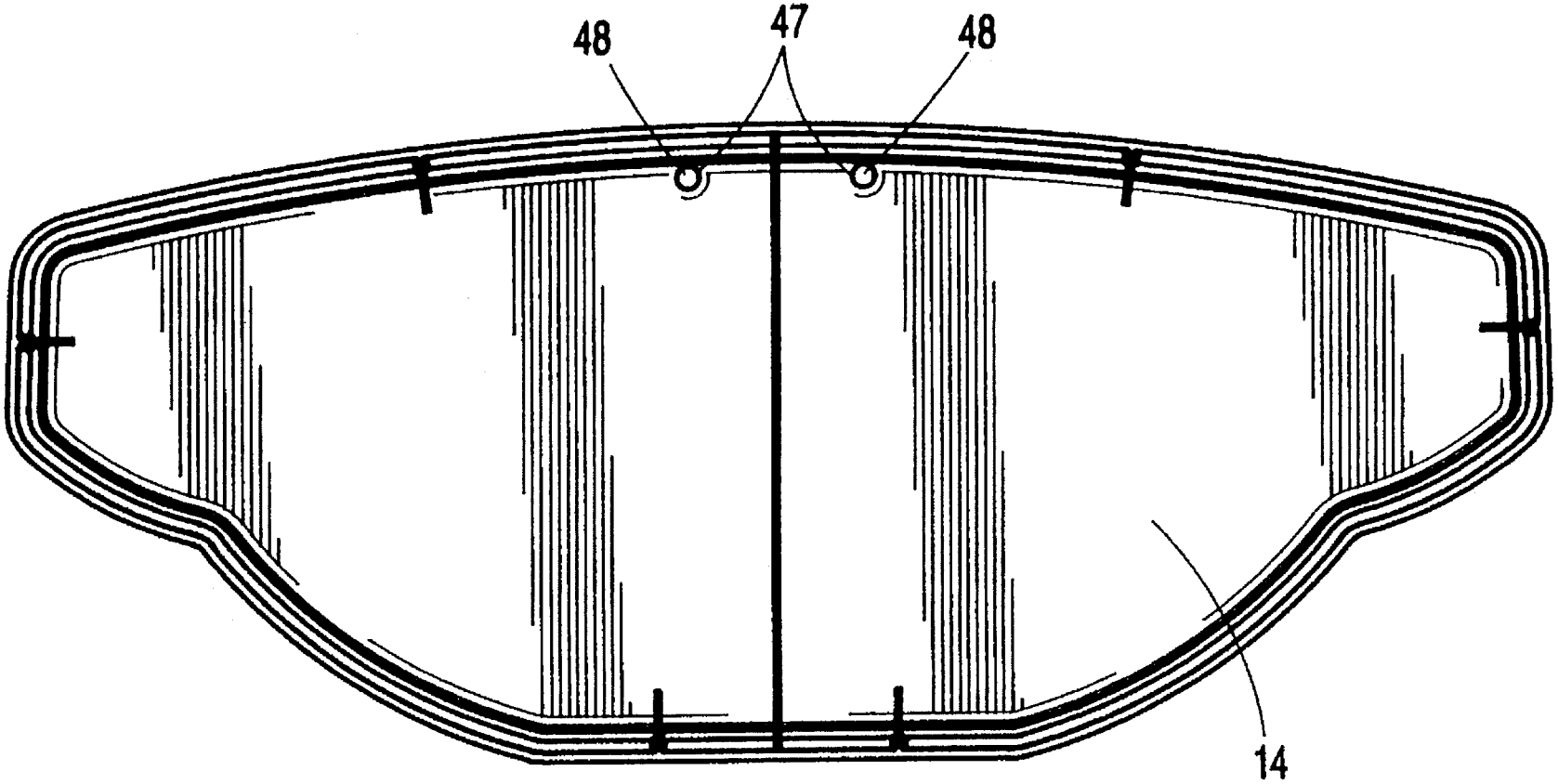
FIG. 5 is a bottom plan view thereof.
Figure 6:
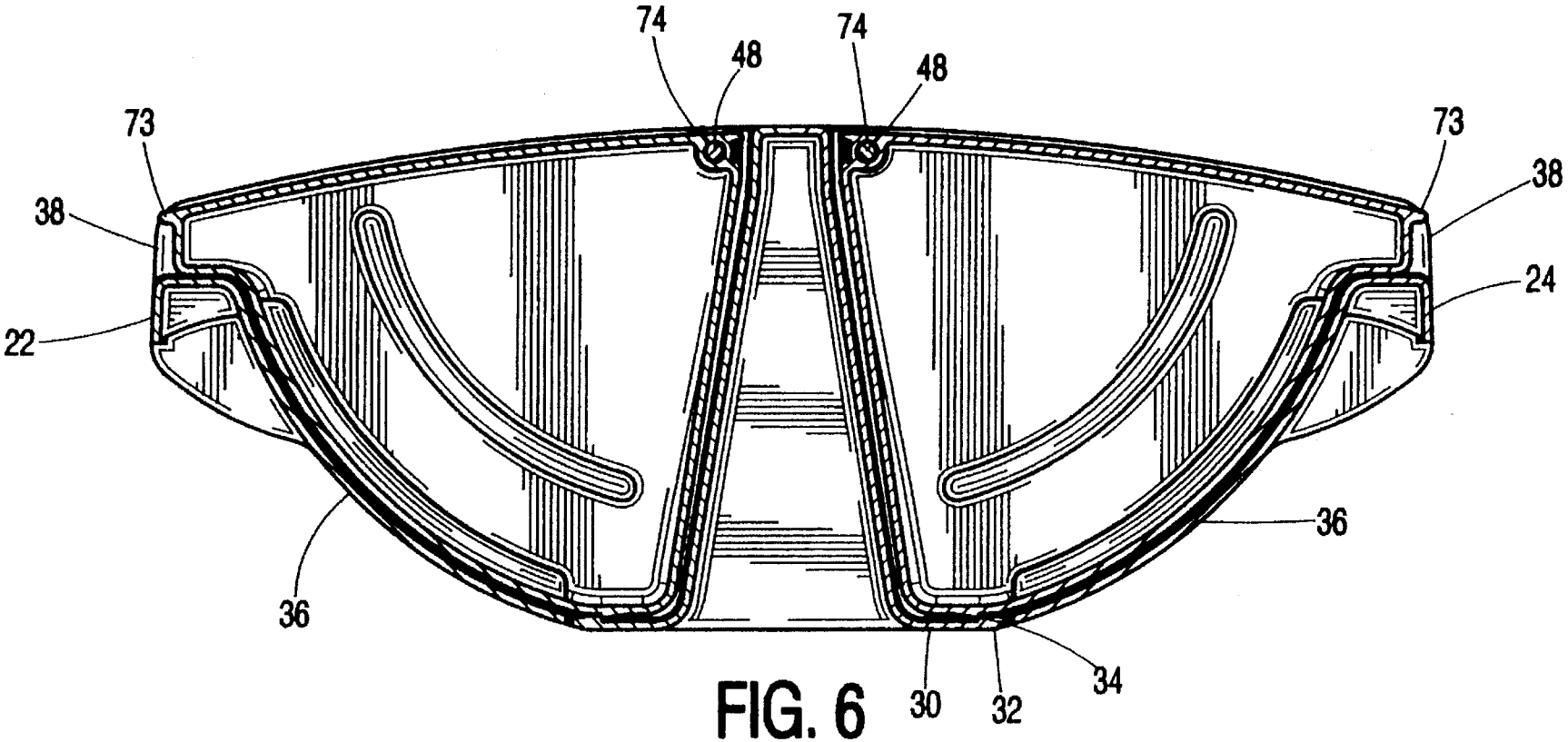
FIG. 6 is a transverse section view thereof, taken along the line 6—6 of FIG. 3.

Referring next to FIGS. 1, 2, and 6, a plurality of bins 62 are provided, one for each compartment 26. Each bin 62 is configured to have a generally complimentary triangular shape to the compartment 26 in which it resides, defined by a forward bin side 64, a planar inward side 66, and an arcuate outward side 68. A floor surface 70 of the bin together with the sides 64, 66, 68 define an upwardly open chamber 72, sized to contain and store small parts such as screws, nails, or other fasteners. The bins each have a vertical flange 73 extending from the front side 64 outward and beyond the bin arcuate side 68. The flange 73 is thus located at the intersection of the forward side 64 and the arcuate side 68.

Figure 7:
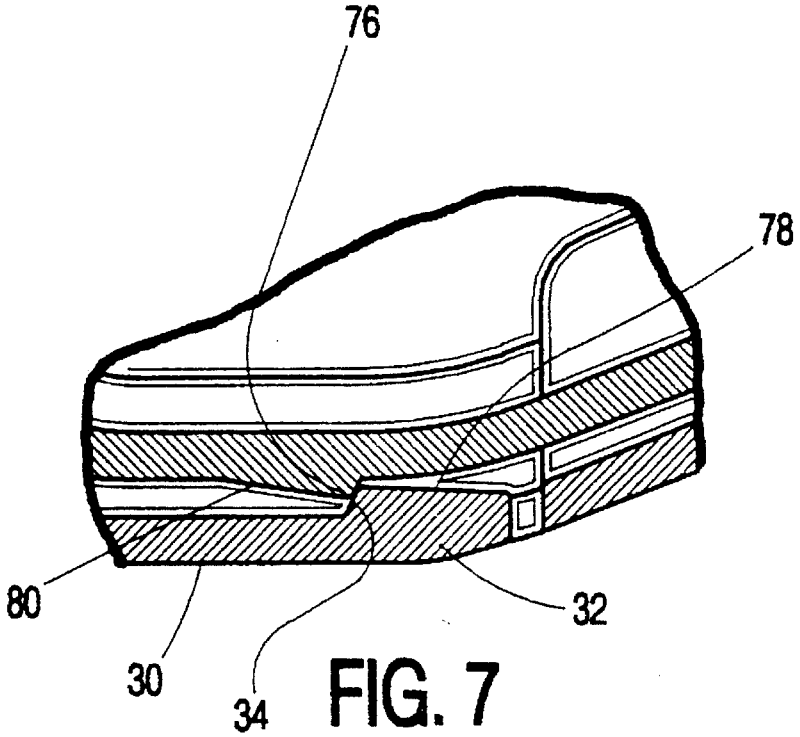
FIG. 7 is a natural section view through a bin and a portion of the rearward wall of the cabinet, taken along the line 7—7 of FIG. 4.
Figure 8:
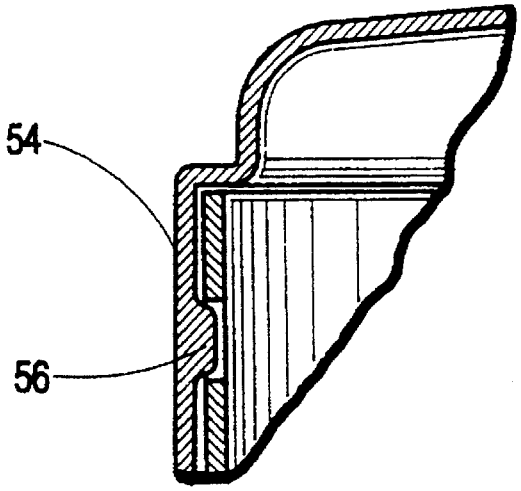
FIG. 8 is a partial section view through the corner of the cabinet showing the attachment of top cover to the base, taken along the line 8—8 of FIG. 4.

Opposite the flange 73, at an inward corner of the bin 62, is a vertically oriented through bore 74 that is sized to receive one of the pivot rods 48. A ramped projection 76 is disposed to project rearward from the outward bin side 68 as shown in FIGS. 6 and 7. The projection is positioned to intersect and engage the leaf spring end portion 32 as the bin is pivoted into its storage configuration.

Assembly of the subject cabinet proceeds as follows. The bins 62 are seated within their respective compartments 26, with the forward bin sides 64 to the front of the housing 12, the inward side 66 internal of the housing 12, and the arcuate bin side 68 extending parallel to the arcuate portion 36 of the housing side panels 18, 20. The rods 48 are inserted through the housing bores 46, and through the co-aligned corner bores 74 of the bins 62, and until seated into place. Thereafter, the cover 52 is attached over the top of the housing 12 to enclose and hide the top surface 16 of the housing 12.

It will be appreciated that the bins 62 thus are pivotally coupled to the housing 12 by the rods 48, and pivot between the position shown by the majority of bins in FIG. 1, the storage position, and that shown by the single bin in FIG. 1, the open position. As each bin 62 swings back into its compartment, its ramped shoulder 76 engages against, and deflects outwardly, the end portion 32 of its associate leaf spring 30. When the bin 62 reaches its storage position, the shoulder 76 engages over the leaf spring shoulder 34 to retain the bin within its compartment. FIGS. 6 and 7 illustrate the engagement between the leaf spring shoulder 34 and the bin shoulder 76. It will further be noted that as shoulder 76 of the bin 62 engages the leaf spring, it flexes the leaf spring outward. Thereafter, the leaf spring exerts a residual, inwardly directed spring force against the bin which reinforces the locking engagement between shoulders 34, 76 and securely keeps the bin in its storage position.

The locking engagement between shoulders 34, 76 keep the bins from inadvertently opening and spilling. The edge flanges 73 of the bins 62 in the storage position reside within the vertical channels 38. So positioned, they are recessed and protected from inadvertent contact with external objects that might cause an unwanted opening of the bins. To open the bin of choice, the user grasps the flange 73 and initiates an outward pivot of the bin, overcoming the retention force exerted by the leaf spring 30. As the shoulders 34, 76 disengage, the leaf spring residual force is directed through its ramped inward surface 78 (FIG. 7) to the ramped outward surface 80 of the bin shoulder 76. The directional application of the spring force pushes the bin surface 80 outward and ejecting the bin from its compartment.

In the fully open position, illustrated by the single bin in FIG. 1, the bin chamber 72 is accessible and the user may extract its contents. Each of the bins 62 may be opened and closed independently of the other bins, lessening the spillage which would otherwise occur if the housing were to tip over. Also, it will be apparent that the bins are symmetrical about the center axis of the housing 12, further adding stability to the assembly.

The positive lock between the springs 30 and the bin shoulders 76 retain the bins in the storage position until released therefrom by the user. The springs 30 serve in a dual capacity; first, in applying a retention force to the bins, and secondly, in applying an ejecting force to assist in pivoting the bins from their compartments. The bins are preferably molded from transparent plastic such as polypropylene so as to enable the user to discern the contents thereof visually. The housing 12 and the cover 52 are likewise formed preferably from commercial plastic material, and the pivot rods 48 are of metal.

While the above describes the preferred embodiment of the present invention, the invention is not intended to be so confined. Other embodiments, which will be apparent to those skilled in the art, and which utilize the teachings herein set forth, are intended to be within the scope and spirit of the invention.

We claim:

1. A compartmented storage cabinet, comprising:

a housing having a rearward panel, first and second side panels, a top panel, and a bottom panel, the panels defining at least one compartment that opens to a forward side of the housing;

a vertically oriented pivot rod positioned adjacent the compartment;

a storage bin having a bottom wall, a forward wall, and at least one side wall defining therebetween an upwardly open chamber, the bin having a first corner pivotally connected to the pivot rod and the bin pivots between a storage position within the housing compartment and an open position forward of the housing, wherein the bin chamber is exposed and accessible;

retention means disposed within the housing compartment for releasably detaining the bin in the storage position; and the housing has biasing means for assisting pivotal movement of the storage bin from the storage position toward the open position.

2. A storage cabinet according to claim 1, wherein the retention means comprises a resilient leaf spring connected to the rearward panel of the housing and positioned to engage the bin as the bin reaches the storage position and exert a frictional retention force upon the bin.

3. A storage cabinet according to claim 2, wherein the biasing means comprises the leaf spring positioned to direct an ejection force upon the bin when the frictional retention force is overcome.

4. A storage cabinet according to claim 3, wherein the storage bin has a flange extending outward from a second corner opposite the first corner; the flange extends beyond one of the cabinet side panels with the bin in the storage position and provides a user with a means for grasping the bin and initiating pivotal movement of the bin out of the storage position and into the open position.

5. A storage cabinet according to claim 4, wherein the bin flange is a continuous extension of the forward wall of the bin and extends outward beyond a bin lateral wall.

6. A storage cabinet according to claim 5, wherein the cabinet comprises a vertical array of plural storage bins, housing compartments, and leaf springs, each bin pivots under the influence of a respective leaf spring between the storage position in a respective compartment and the open position, independently of the other bins in the array.

7. A storage cabinet according to claim 6, wherein the cabinet further comprises a second pivot rod attached at opposite ends to the housing top and bottom panels and extends vertically therebetween, the second pivot rod positioned adjacent and parallel the first pivot rod and a second vertical array of storage bins pivotally attached thereto and pivots under the influence of a second vertical array of leaf springs between the storage position in a second vertical array of housing compartments and the open position.

8. A compartmented storage cabinet, comprising:

a housing having a bottom surface, a top surface, a forward panel, a rearward panel, and a first and a second side panel extending upward from the bottom to the top surface, the housing having at least one compartment positioned between the side panels, and the compartment opens to the forward panel of the housing and extends rearwardly to the rearward panel of the housing;

a first vertically oriented pivot rod positioned adjacent the compartment;

a storage bin having a bottom wall, a forward wall, a lateral wall, and a rearward wall defining an internal, upwardly open chamber, and the bin has a first corner pivotally connected to the pivot rod and the bin pivots between a storage position within the housing compartment in which the bin forward wall substantially covers the compartment and the bin lateral wall is adjacent and in proximity to one of the housing side panels, and an open position forward of the housing compartment wherein the bin chamber is exposed and accessible;

retention means within the compartment for releasably detaining the storage bin in the storage position; and the housing has biasing means for assisting pivotal movement of the storage bin from the storage position toward to the open position.

9. A storage cabinet according to claim 8, wherein the retention means comprises a resilient leaf spring connected to the rearward panel of the housing and positioned to engage the bin as the bin reaches the storage position and exert a frictional retention force upon the bin.

10. A storage cabinet according to claim 9, wherein the biasing means comprises the leaf spring positioned to direct an ejection force upon the bin when the frictional retention force is overcome.

11. A storage cabinet according to claim 10, wherein the bin comprises a triangular body in which the forward, rearward, and lateral bin walls comprise the three sides of the body.

12. A storage cabinet according to claim 11, wherein the bin has a flange extending outward from a second corner opposite to the first corner; the flange extends beyond one of said cabinet side panels with the bin in the storage position, whereby providing a grip by which a user can grasp the bin and initiate pivotal movement of the bin out of the storage position and into the open position.

13. A storage cabinet according to claim 12, wherein the flange is an extension of the forward wall of the bin and extends outward beyond the bin lateral wall.

14. A compartmented storage cabinet, comprising:

a housing having a bottom surface and a top surface, and a forward panel, a rearward panel, and a first and a second side panel extending upward from the bottom to the top surface, the housing has a first vertical array of compartments positioned vertically against one of the side panels and a second vertical array of compartments positioned vertically against the opposite one of the side panels, the compartments open to the forward panel of the housing and extend rearwardly to the rearward panel of the housing;

a first pivot rod and a second pivot rod positioned between the housing bottom surface and at their upper ends to the housing top surface to extend vertically therebetween in an adjacent and parallel orientation and positioned between the first and the second arrays of compartments;

a plurality of storage bins, each having a bottom wall, a lateral wall, a forward wall and a rearward wall defining an internal, upwardly open chamber, and each bin having an inward corner connected to a respective one of the pivot rods and the bin pivots between a storage position within a respective housing compartment in which the bin forward wall substantially covers the respective compartment and the bin lateral wall is adjacent and in close proximity to one of the housing side panels, and an open position forward of the respective housing compartment wherein the bin chamber is exposed and accessible; and the bins pivot independently of each other between the storage and the open positions; and the housing compartments each have retention means for inhibiting pivotal movement of the bin associated therewith from the storage position to the open position and biasing means for assisting pivotal movement of the storage bin associated therewith from its storage position to its open position.

15. A storage cabinet according to claim 14, wherein the retention means comprises a first and a second vertical array of resilient leaf springs connected to the rearward panel of the housing and position to engage a respective bin as the bin reaches the storage position and exert a frictional retention force upon the bin.

16. A storage cabinet according to claim 15, wherein the biasing means comprises the first and the second vertical arrays of leaf springs each positioned to exert an ejection force upon a respective bin when the frictional retention force is overcome.

17. A storage cabinet according to claim 16, wherein each bin comprises a triangular body in which the forward, rearward, and lateral bin walls comprise the three sides of the triangular body.

18. A storage cabinet according to claim 17, wherein each bin has a flange extending outward from an outward corner opposite to the inward corner, the flange extends beyond the side of the respective compartment with the bin in the storage position, whereby providing a grip by which a user can grasp the bin and initiate pivotal movement of the bin out of the storage position and into the open position.

19. A storage cabinet according to claim 18, wherein the flange of each bin is an extension of the forward wall of the bin and extends outward beyond the bin lateral wall.

20. A compartmented storage cabinet, comprising:

a housing having at least one internal compartment opening to a forward side of the housing, the compartment defined by lateral side walls and a rearward compartment wall;

a vertically oriented pivot rod secured to the housing and positioned adjacent the compartment forward side;

a storage bin having a bottom wall, a forward wall, a lateral wall, and a rearward wall defining an internal, upwardly open chamber, and the bin has a first corner pivotally connected to the pivot rod and the bin pivots between a storage position within the housing compartment and an open position forward of the housing, wherein the bin chamber is exposed and accessible; and a leaf spring connected to the compartment rearward wall and positioned to engage and retain the bin when the bin reaches the storage position and to direct an ejection force upon the bin when the bin is released from the storage position.

21. A storage cabinet according to claim 20, wherein the storage bin deflects the leaf spring outward from an initial orientation as the storage bin reaches the storage position.

22. A storage cabinet according to claim 21, wherein the storage bin and the leaf spring have opposed shoulder portions that abut as the storage bin reaches the storage position.

23. A storage cabinet according to claim 22, wherein the abutting opposed shoulder portions disengage subject to application of an outwardly directed force upon the bin, whereupon the leaf spring in resiliently resuming said initial orientation exerts an ejection force upon the bin.

* * * * *